United States Patent [19]

Mercer

[11] Patent Number: 5,015,103

[45] Date of Patent: May 14, 1991

[54] SIDE LOADABLE BAG

[75] Inventor: Joseph B. Mercer, Hickory, N.C.

[73] Assignee: Plastic Packing, Inc., Hickory, N.C.

[21] Appl. No.: 567,767

[22] Filed: Aug. 15, 1990

[51] Int. Cl.[5] ..... B65D 33/08

[52] U.S. Cl. ..... 383/10; 383/66; 383/120

[58] Field of Search ..... 383/9, 10, 66, 120

[56] References Cited

U.S. PATENT DOCUMENTS

| | | | |
|---|---|---|---|
| 2,686,004 | 8/1954 | Reiss . | |
| 2,789,728 | 4/1957 | Britton | 383/10 |
| 2,951,628 | 9/1960 | Grussen | 383/10 |
| 3,249,285 | 5/1966 | Dollheimer et al. | 383/9 |
| 3,255,951 | 6/1966 | Kay | 383/10 |
| 3,402,749 | 9/1968 | Kinzler . | |
| 3,504,841 | 4/1970 | Bramson . | |
| 3,506,185 | 4/1970 | Christensen | 383/10 |
| 3,548,723 | 12/1970 | Sengewald | 383/10 |
| 3,732,661 | 5/1973 | Goldberger et al. . | |
| 3,977,596 | 8/1976 | Gamble . | |
| 4,691,368 | 9/1987 | Roessiger . | |
| 4,721,396 | 1/1988 | Sengewald | 383/120 |
| 4,966,286 | 10/1990 | Muckenfuhs | 383/10 |

FOREIGN PATENT DOCUMENTS 1411575 10/1968 Fed. Rep. of Germany .

*Primary Examiner*—Stephen P. Garbe

*Attorney, Agent, or Firm*—Roy B. Moffitt

[57] ABSTRACT

A bag adapted to receive and contain merchandise through a side opening, made from a sheet of flaccid material folded along a fold line to provide two side by side overlapping wall panels, the wall panels joined together along two spaced apart pairs of side edges and another pair of side edges, unattached to one another forming an opening in the bag and the fold line disposed inwardly between the wall panels to form a gusset with a part of the wall panels. A portion of the wall panels and the gusset protrude beyond a terminal free edge of one of the joined together pair of side edges to form a handle portion integral with the balance of the bag.

6 Claims, 5 Drawing Sheets

SIDE LOADABLE BAG

BACKGROUND OF THE INVENTION

This invention is a bag having a gusset made of a sheet of flaccid material adapted to overlap on itself forming a gusset and opposing sidewalls joined together at their edges so that it may be loaded with merchandise from a side rather than the top or bottom of the bag. A side loadable bag made from paper is disclosed in U.S. Pat. No. 3,504,841, the contents of which are incorporated herein by reference. However, this prior art bag does not provide for a handle portion, formed partly from a gusset and partly from the overlapping side walls, protruding from one of the joined together side edges as does the present invention.

Prior art side loadable bags are generally made of a plurality of parts (especially if a handle is desired) rather than from a single sheet of flaccid material as is the case with the present invention. Conventional machinery used in making plastic bags, such as that used to make the bags disclosed in U.S. Pat. Nos. 4,539,705 and 4,730,943, may be modified to make the bags of the present invention, which in turn can be used in automatic, as well as hand loading operations.

BRIEF DESCRIPTION OF THE INVENTION

The invention is a side loadable bag, made in the most part, from a single sheet of flaccid material. A single sheet of plastic, such as polyethylene, is folded onto itself to form a fold line and two opposing side walls. The fold line is tucked inwardly in between the opposing side walls to form a gusset that lies between two spaced apart pairs of free edges of the side walls. Each pair of these free edges are sealed together to form first and second seams. A third seam is formed inwardly from and spaced apart from the second seam, (between the first and second seams) sealing together the overlapping side walls of the bag not forming a part of the gusset and the overlapping side walls of the gusset, forming a terminal portion integral with the balance of the bag, but separated from the body of the bag by the third seam. A portion of this terminal portion, that portion composed of overlapping side walls, is removed, leaving and forming a handle portion, partly made up of a portion of the gusset and partly from a portion of opposing side walls. This handle portion is partly circumscribed by seams, contains an aperture plus reinforcing members circumscribing the aperture affixed to opposite sides of the handle portion. In between the first and third seam, spaced apart from the fold line is a pair of free edges of the side walls, not joined to one another forming an opening, through which merchandise may be loaded. Ultimately, this pair of side edges are joined to close the bag after loading of merchandise.

DETAILED DESCRIPTION OF THE INVENTION

Figure 1:
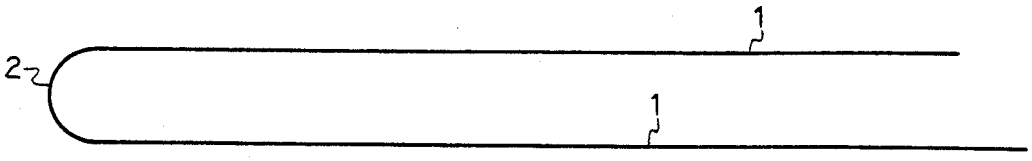
FIG. 1 is a side elevation of a single sheet of flaccid material folded to form a fold line.
Figure 2:
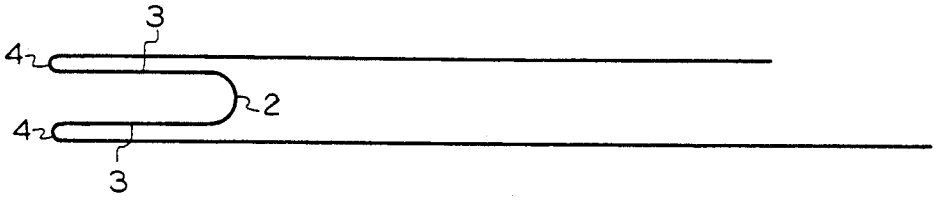
FIG. 2 is a side elevation of the flaccid material of FIG. 1 with the fold line tucked inwardly to form a gusset.
Figure 3:
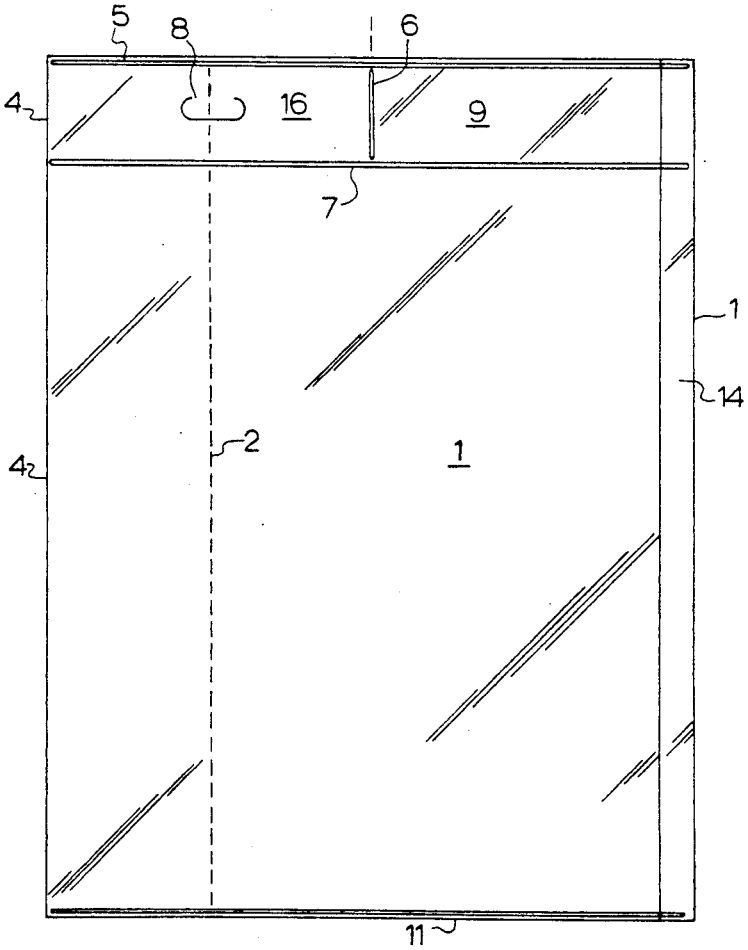
FIG. 3 is a plan view of the flaccid material of FIG. 2 complete with seams to form the bag of the invention.
Figure 7:
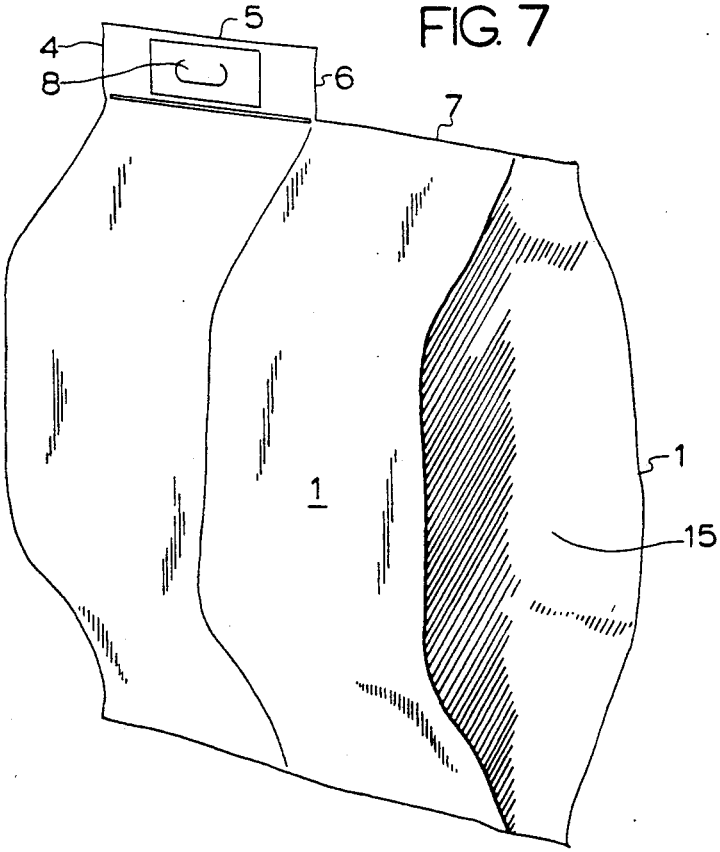
FIG. 7 is a perspective view of the bag of the invention showing side opening 15.

Shown in FIG. 1 by element 1 is a rectangular sheet of flaccid material, such as polyethylene, folded over itself to form a fold line 2 creating opposing sidewalls 1—1. In FIG. 2, fold line 2 is tucked inwardly forming opposing sidewalls 3 and terminal edges 4. Elements 2, 3, and 4 form a gusset, a structure well known in the bag art. See for example, U.S. Pat. Nos. 4,539,705 and 4,730,943. The structure of FIG. 2, shown in plan view in FIG. 3, is further modified by sealing together the opposing side walls by seams 5, 6, 7, and 11. Such seams form a bag with a side opening 15 (FIG. 7). Generally, it is advantageous to have one of sidewalls 1—1 slightly longer than the other as shown by element 14. Seams 5, 6, 7, and 11 are joining seams that can be made using heating apparatus or ultrasonic vibration devices, such seams sealing together sidewalls of the bag and sidewalls of the gusset wherever the seams are applied. It will be noted that there is no seam along fold line 4.

Figure 4:
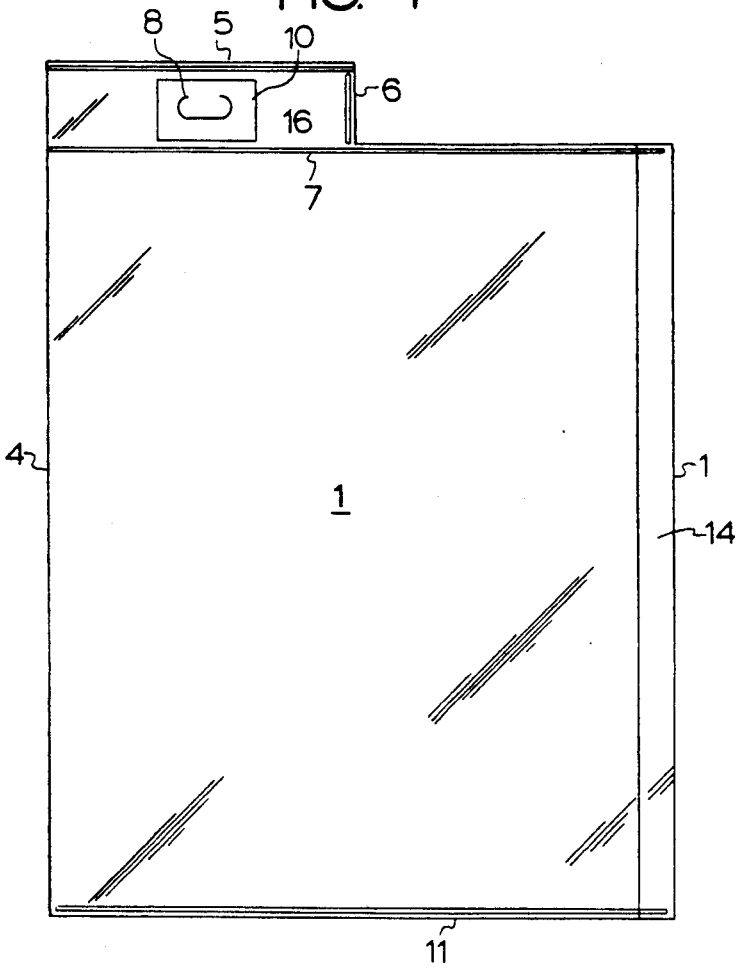
FIG. 4 is a plan view of the bag of FIG. 3 showing removal of portion 9 to form a handle portion.

Fold line 4, seams 5, 6, and 7 delimit a handle portion 16 in which there is cut out an aperture 8. Throwaway portion 9 is bounded by seams 5, 6, and 7. It is cut away and discarded to form the configuration as shown in FIG. 4. The bag of FIG. 4 has an additional feature, reinforcing element 10 around aperture 8. Reinforcing means 10 surround aperture 8 and are applied to both sides of the handle 16.

Figure 5:
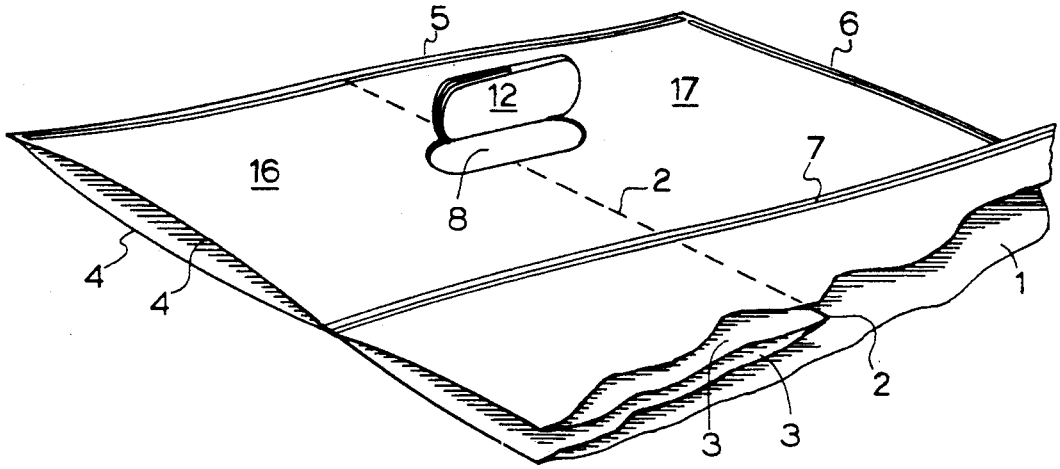
FIG. 5 is a cut-a-way view of the finished bag showing the detail of the gusset portion.
Figure 6:
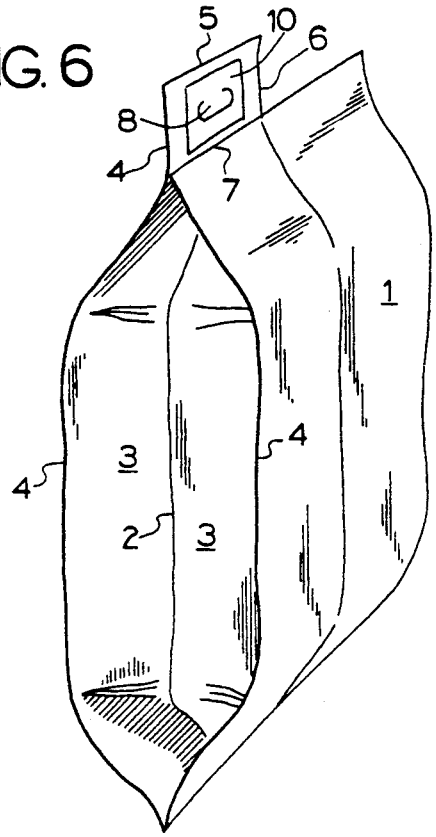
FIG. 6 is a perspective view of the finished bag showing the detail of the gusset portion.
Figure 8:
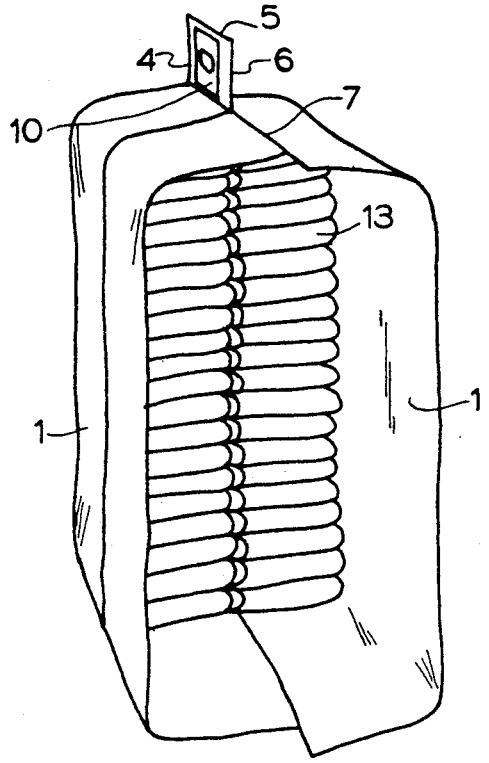
FIG. 8 is a perspective view of the bag of the invention loaded with merchandise.
Figure 9:
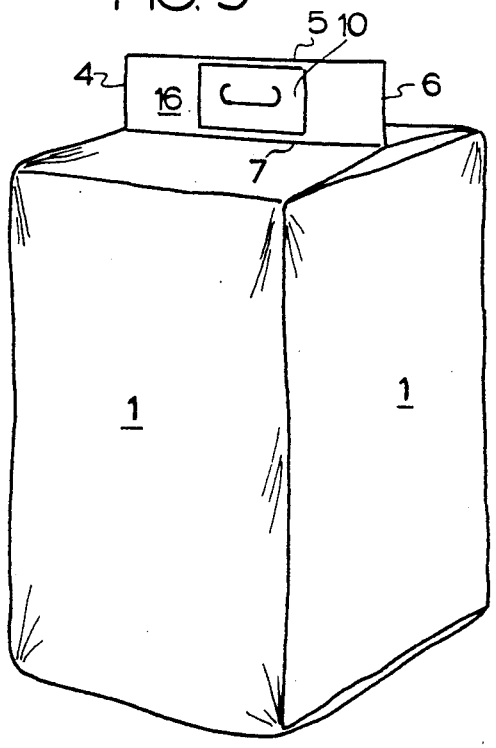
FIG. 9 is a perspective view of the bag of FIG. 8 with sidewalls sealed together to enclose the merchandise.
Figure 10:
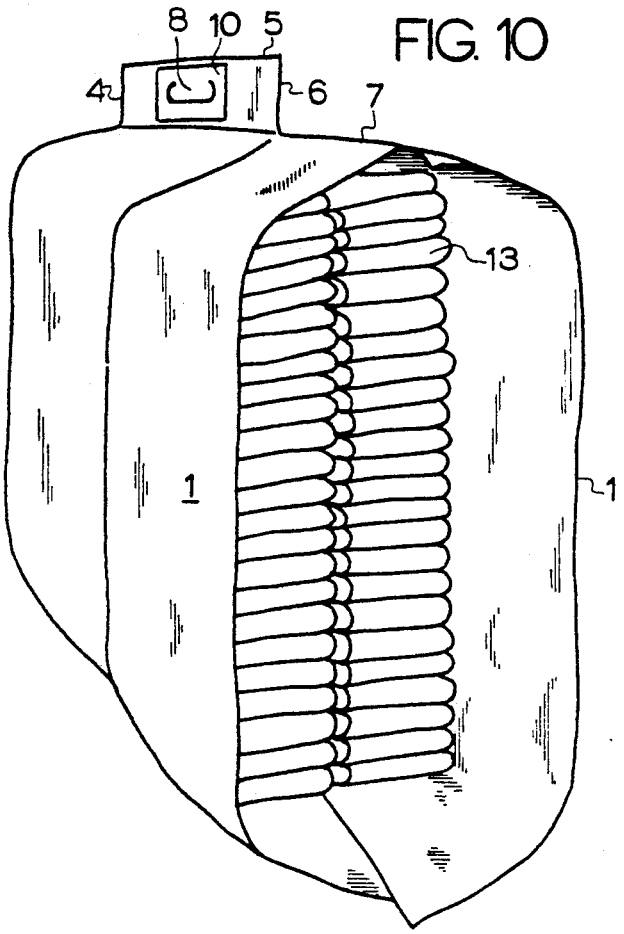
FIG. 10 is a perspective view of the bag of the invention containing a greater volume of merchandise than that shown in FIG. 8.
Figure 11:
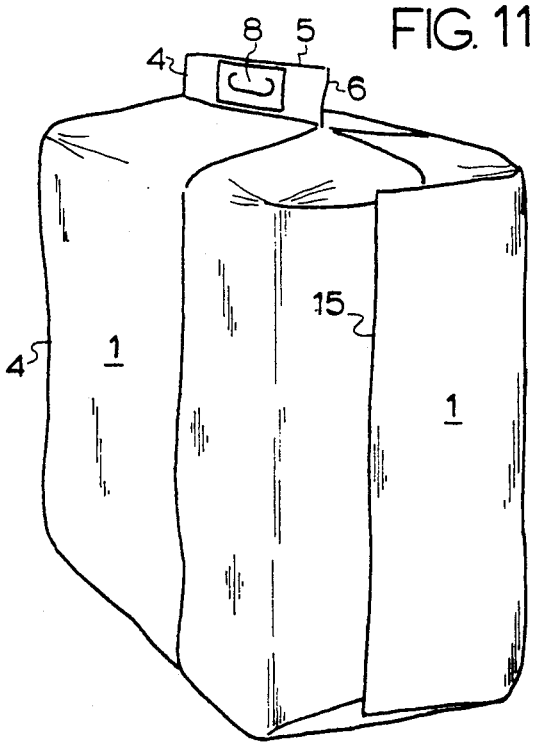
FIG. 11 is a perspective view of the loaded bag of FIG. 10 with sidewalls sealed together to enclose the merchandise.

In most instances, it will be advantageous, in cutting aperture 8, not to completely remove all of the material and to leave some material identified by element 12 in FIG. 5. FIG. 5, a prospective view of a portion of the bag, shows that the handle portion 16 is made up of two parts, a gusset part 16 and a part not forming a part of the gusset 17. FIGS. 6 and 7 are perspective views of the bag of the invention showing the gusset side (elements 2, 3, and 4). On the opposite side there is an opening 15, which results in a bag that is opened on one side and adapted for side loading. Reference is made to FIGS. 8 and 9 showing how the side loadable bag may be loaded with a volume of merchandise 13 and subsequently the left over portion of sidewalls 1 are folded over one another as shown in FIG. 9 and sealed. Note that with the merchandise volume shown in these figures, handle portion 16 is centered. When a larger volume of merchandise 13 is desired, the bag is loaded as shown in FIG. 10. In this instance, left over overlapping wall panels are folded over and in some instances, tab 14 is used as a means to seal the overlapping wall panels 1—1 together. See FIG. 11.

In all cases, it is to be understood that the above described embodiment is illustrative of one of the many possible specific embodiments which may represent the principles of my invention. Numerous and various other embodiments can be devised readily in accordance with these principles by those skilled in the art without departing from the spirit and scope of my invention.

What is claimed is:

1. A bag for receiving and containing merchandise comprising a sheet of flaccid material folded along a fold line to provide two overlapping wall panels, said wall panels having spaced apart first and second pairs of edges, the edges of each pair joined together to form first and second spaced apart seams delimiting a bag cavity, and a third pair of edges disposed between said first and second seams unattached to one another and spaced apart from said fold line, said fold line being disposed inwardly between said overlapping wall panels forming a gusset with a part of said overlapping wall panels, and a handle portion, comprising a portion of said gusset and a portion of said overlapping wall panels not forming a part of said gusset, protruding beyond said bag cavity.

2. The bag of claim 1 further including an aperture in said handle portion and first and second reinforcing devices, at least partially circumscribing said aperture, affixed to opposite surfaces of said handle portion.

3. The bag of claim 1 wherein said handle portion is delimited at least in part by, either said first or second seams, and third and fourth seams.

4. The bag of claim 3 wherein said third seam forms a terminal free edge of said handle portion and spaced apart from said first and second seams and joins together the overlapping side walls forming said gusset and the overlapping side walls not forming part of the gusset.

5. The bag of claim 4 wherein said fourth seam joins together a part of the overlapping sidewalls not forming a part of the gusset and abuts either said first or second seam and said third seam.

6. A bag for receiving and containing merchandise comprising a sheet of flaccid material folded along a fold line to provide two overlapping wall panels, said wall panels having spaced apart first and second pairs of edges, the edges of each pair joined together to form first and second spaced apart seams delimiting a bag cavity having merchandise therein, and a third pair of edges disposed between said first and second seams and attached to one another and spaced apart from said fold line, said fold line being disposed inwardly between said overlapping wall panels forming a gusset with a part of said overlapping wall panels, and a handle portion, comprising a portion of said gusset and a portion of said overlapping wall panels not forming a part of said gusset, protruding beyond said bag cavity seams.

* * * * *

UNITED STATES PATENT AND TRADEMARK OFFICE

CERTIFICATE OF CORRECTION

PATENT NO. : 5,015,103

DATED : May 14, 1991

INVENTOR(S) : Joseph B. Mercer

It is certified that error appears in the above-identified patent and that said Letters Patent is hereby corrected as shown below:

Column 3, line 17, after the word "another", insert the words --forming an opening into said bag cavity--.

Signed and Sealed this

First Day of December, 1992

*Attest:*

*Attesting Officer*

DOUGLAS B. COMER

*Acting Commissioner of Patents and Trademarks*